United States Patent [19]

Pellegrino

[11] Patent Number: 4,997,160

[45] Date of Patent: Mar. 5, 1991

[54] BALL LOCK CONTROL VALVE ACTUATION PLUNGER - HYDRAULIC TYPE

[75] Inventor: Joseph C. Pellegrino, Baldwin, N.Y.

[73] Assignee: Grumman Aerospace Corporation, Bethpage, N.Y.

[21] Appl. No.: 534,950

[22] Filed: Jun. 8, 1990

[51] Int. Cl.[5] ..... F15B 13/01

[52] U.S. Cl. ..... 251/62; 91/43; 251/297

[58] Field of Search ..... 91/393, 43; 251/62, 251/297

[56] References Cited

U.S. PATENT DOCUMENTS 3,737,143 6/1973 Hodler ..... 281/28

*Primary Examiner*—Gerald A. Michalsky

*Attorney, Agent, or Firm*—Pollock, VandeSande & Priddy

[57] ABSTRACT

An ancillary hydraulic driven ball lock control valve actuation plunger cooperates with a piston for displacing a timer valve. An annular locking plunger is pressurized by fluid at a control port, the sliding motion of the plunger controlling the position of locking balls. As the locking balls change their position, they vary the radial extension of a further plunger assembly, the latter having detent means for displacing the plunger of a timer valve and thereby changing the valve's state.

5 Claims, 3 Drawing Sheets

LOCKED

UNLOCKED

UNLOCKED

LOCKED

BALL LOCK CONTROL VALVE ACTUATION PLUNGER - HYDRAULIC TYPE

RELATED APPLICATION

This application relates to my co-pending U.S. patent application Ser. No. 07/556,991, assigned to a common assignee and filed July 25, 1990. The co-pending application is entitled BALL LOCK CONTROL VALVE ACTUATION PLUNGER - MECHANICAL TYPE.

FIELD OF THE INVENTION

The present invention relates to control valves, and more particularly to a ball lock actuation plunger for such a valve which is hydraulically driven.

BACKGROUND OF THE INVENTION

In hydraulic systems it is often necessary to create a timing sequence so that different operations performed by the hydraulic system are done at prescribed intervals relative to one another. The prior art includes various methods for keying a movable piston to a timing mechanism so that, as the piston is moved to a particular position, a timer valve is actuated thereby sequencing further operation of a hydraulic system. A problem in prior art actuating systems has been the existence of fairly complex mechanisms having numerous components which decrease the reliability of the system.

BRIEF DESCRIPTION OF THE PRESENT INVENTION

The present invention is a hydraulically driven ancillary device that actuates a timer valve thereby sequencing further operation of a larger hydraulic system which, in not per se part of the invention.

The present invention employs rather simple and quite reliable components for causing actuation of a timer valve as a hydraulic cylinder is driven between two end positions.

The present invention results in an economical and precise means for actuating a timer valve thereby creating reliable sequencing of a main hydraulic system.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

Figure 1:
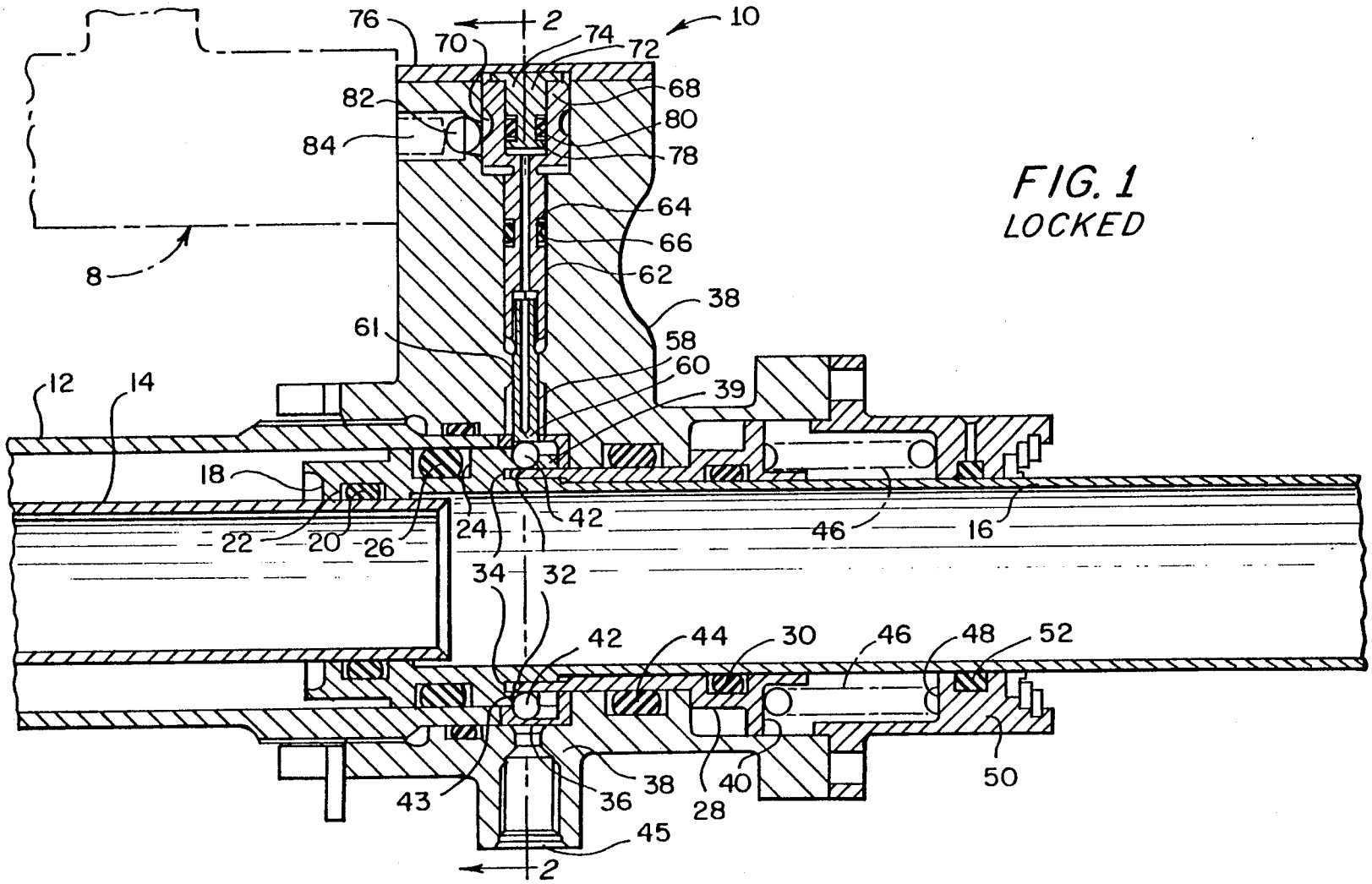
FIG. 1 is a longitudinal sectional view indicating the internal components of the present invention wherein a piston is indicated in a locked position.

A ball lock control valve actuating plunger assembly is generally indicated by reference numeral 10 in the figures. In FIG. 1 the assembly is shown with a main piston 16 in a locked position. The purpose of the assembly is to actuate a timer valve 8 to either port fluid or not port fluid to the hydraulic system in response to the displacement of piston 16 between the locked position shown in FIG. 1 and the unlocked position shown in FIG. 1A.

In order to understand the structure and operation of the present invention, reference is made to FIG. 1 wherein the piston 16 is shown in a locked position (extended) relative to an outer cylinder barrel 12. The interior surface of the piston 16 rides along the exterior surface of a guide tube 14. Piston 16 is moved to the indicated locked position of FIG. 1 by porting a driving pressure along the left-most end of the piston, namely the piston head 18. A groove 22 is formed inwardly from the left end of the piston head 18 so as to receive an O-ring 20 for sealing the interface between the piston head and the guide tube 14. A second groove 24 is formed in the head of the piston 16, at a point further inwardly from the left end of the piston head 18 so as to accommodate an O-ring 26 which creates a seal between the piston head and the cylinder barrel 12. It should be understood that the piston 16 is used to move mechanical members which are not illustrated in the figure and which are not, by themselves, part of the present invention. Rather, the present invention is generalized in terms of indexing timer valve actuation to a hydraulic cylinder displacement.

Figure 1A:
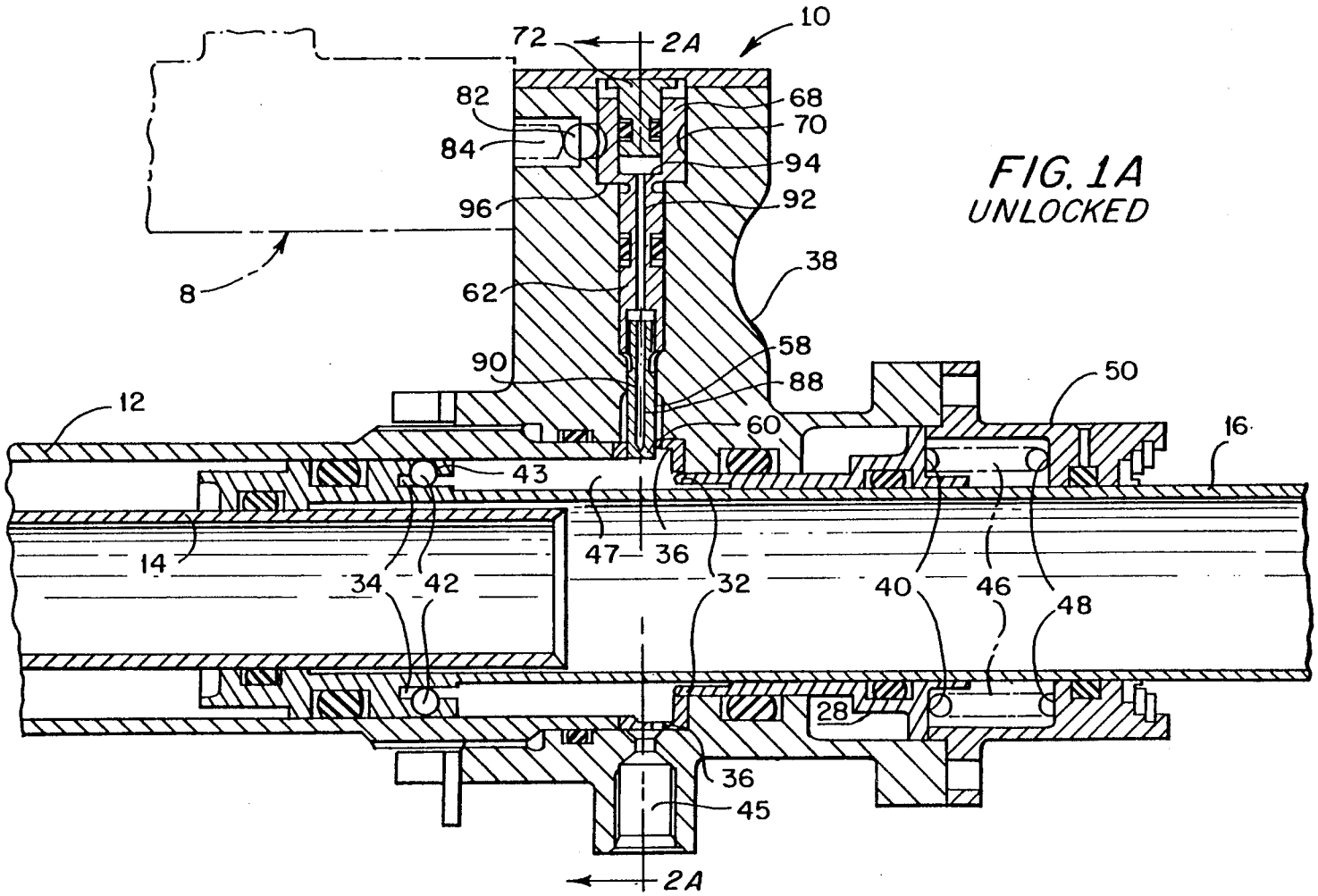
FIG. 1A is a longitudinal sectional view indicating the internal components of the present invention wherein a piston is indicated in an unlocked position.
Figure 2A:
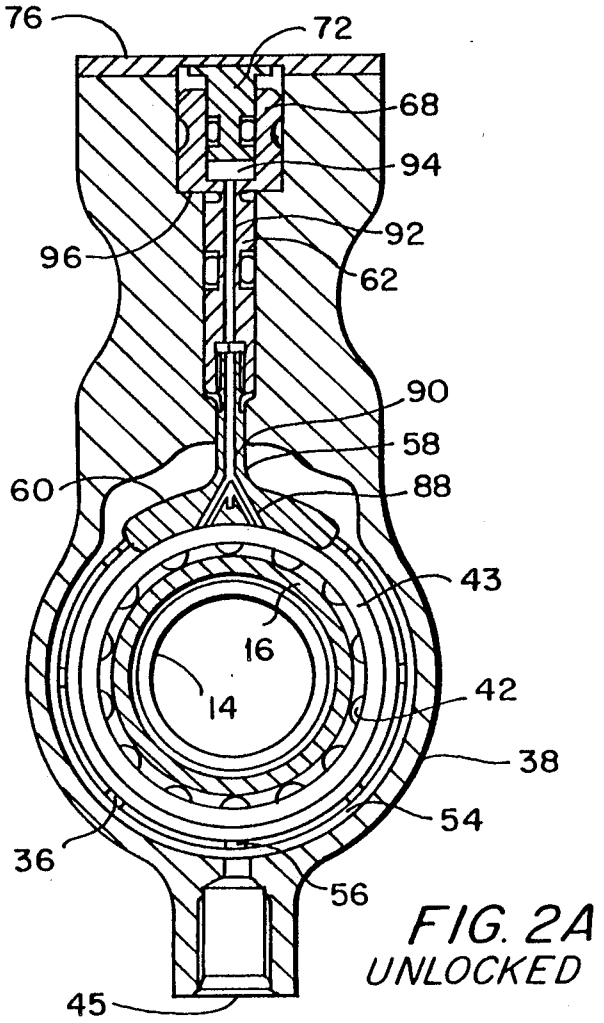
FIG. 2A is a transverse sectional view taken along section line 2A—2A of FIG. 1A.
Figure 2:
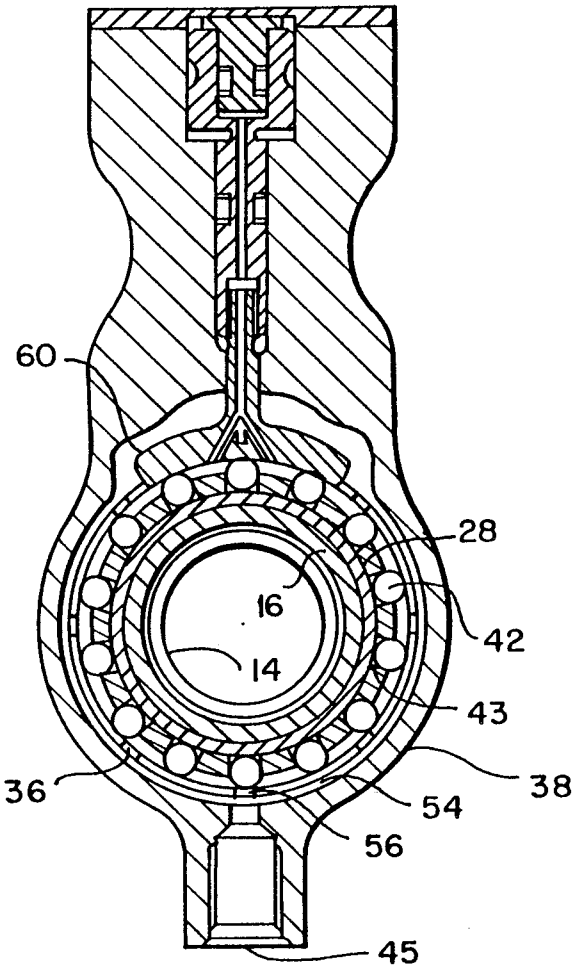
FIG. 2 is a transverse sectional view taken along a plane passing through section line 2—2 of FIG. 1.

As is more clearly shown in FIG. 1A and FIG. 2, a number of recesses 43 are formed around the right end of piston head 18 so as to accommodate locking balls 42. A continuous annular recess 34 clearly shown in FIGS. 1 and 1A receives the left end 32 of a generally cylindrical locking plunger 28. The plunger is contained within a housing 38. A cylindrical race 36 is located at radially inward points of the housing 38; and in the locked position of FIG. 1, the locking balls 42 are adapted to rest within the race. As indicated in FIG. 2, a number of locking balls 42 are positioned within the race, at equally spaced points.

In the locked position shown in FIG. 1, the piston head 18 receives hydraulic pressure so that it is displaced to the right until the right protruding edge 39 of the piston head 18 bottoms against the race 36. During the motion of the piston 16 from the left to the right, the locking balls 42 will contact the lock plunger left end 32 thereby driving the lock plunger 28 to the right thereby compressing the coil spring 46 (FIG. 1). The coil spring 46 (FIG. 1) is contained between an annular shoulder 40 of the locking plunger 28 and an oppositely disposed surface 48 of a gland fitting 50. The fitting 50 includes a groove therein to receive a seal 52. Once the right protruding edge 39 of the piston head 18 bottoms against the race 36, the spring 46 biases the locking plunger 28 in the left direction will force the left end 32 into mating annular recess 34. The presence of the locking plunger 28 against the locking balls 42 causes the balls to be displaced radially outwardly. An O-ring 30 exists between the locking plunger 28 and the rod section of piston 16 while a further O-ring 44 exists between housing 38 and locking plunger 28.

With continued reference to FIG. 1, the radially outward positioning of the locking balls 42 displaces the radially inward end 60 of an indicator plunger 58. The plunger is received within a radial passageway 61 and threadingly engages a coaxial radially outwardly disposed return plunger 62. A groove 64 is formed within the return plunger so as to receive an O-ring 66 which seals the return plunger 62 within the housing 38. As will shortly be explained, the indicator and return plungers operate together to actuate the timer valve 8.

A hollowed cylindrical return plunger head 68 includes a groove 70 circumferentially therearound which receives timer valve ball 82 when the piston is in the unlocked position, as will be later explained in connection with FIG. 1A. A generally cylindrical plunger end 72 is received within the hollow of the return plunger head 68 and the plunger end includes a groove 78 for accommodating an O-ring 80 which creates a seal between the return plunger head 68 and the plunger end 72. The plunger end includes a shoulder 74 which prevents the plunger end from being trapped in the return plunger head 68. The housing cover 76 is used to seal off the housing 38.

The timer valve 8 has a plunger 84 which extends outwardly to contact an adjacent timer valve ball 82. With the piston 16 in the locked position of FIGS. 1 and 2, namely with the locking balls 42 urging the indicator plunger 58 and return plunger 62 radially outwardly, the groove 70 is in misalignment with the timer valve ball 82 so that the timer valve plunger 84 retains a relatively inward position. As will now be explained, when the piston 16 assumes the unlocked position of FIGS. 1A and 2A, the timer valve ball 82 will come into alignment with groove 70 thereby displacing the timer valve plunger 84 incrementally outwardly as shown in FIG. 1A, which changes the state of timer valve 8.

With continued reference to FIG. 1, the unlocking of the piston will now be examined. In order to initiate this situation, fluid is introduced at port 45 and distributed through annular space 54 and as clearly shown in FIG. 2 the locking race 36 includes radial openings 56 therein for permitting passage of port fluid past the locking balls 42 and into annular recess 34 where the pressure applied causes retraction of the locking plunger 28 toward the right position. This allows the locking balls 42 to fall radially inwardly since they are no longer supported by left end 32 of the locking plunger 28. The pressure present from the port within annular recess 34 and on the right protruding edge 39 of the piston head 18 forces piston 16 to the retracted position (displacement to the left) thereby freeing the balls from the race 36. The condition of the components just described is clearly illustrated in FIG. 1A which represents the unlocked position of the piston. The displacement of the locking plunger 28 to the position shown in FIG. 1A causes compression of spring 46 which will, of course, bias the locking plunger 28 back toward the left when the piston 16 is later forced to a locked position.

While the piston is in the unlocked position shown in FIGS. 1A and 2A, the presence of pressurized fluid at port 45 fills circular cavity 47. FIG. 2A shows the existence of branched passages 88 in the indicator plunger 58 which communicate with the circular cavity 47. This allows pressurized fluid to flow through the body of the indicator plunger 58 and continue radially outwardly through connecting passage 90. A further passage 92 in the return plunger 62 further extends the course of the pressurized port fluid until it reaches cavity 94 at the base of the return plunger head 68. The pressure in this cavity forces the connected return and indicator plungers radially inwardly until the head bottoms out along annular shoulder 96 within the housing 38. When so displaced, the timer valve ball 82 becomes aligned with the groove 70 thereby permitting spring-biased timer valve plunger 84 to move incrementally outwardly to a new position which changes the state of the timer valve 8. This situation is clearly indicated in FIG. 1A wherein the figure represents the disposition of all components when the piston is in an unlocked position.

In summary, the present invention offers a reliable hydraulic driven ball lock control valve actuation plunger which reliably and cost efficiently permits the change of state of a timer or other control valve so as to sequence further operation of a hydraulic system that would be connected to the timer valve 8.

It should be understood that the invention is not limited to the exact details of construction shown and described herein for obvious modifications will occur to persons skilled in the art.

I claim:

1. A valve actuator comprising:

a piston head having an annular groove transversely formed therein for receiving a plurality of locking balls;

a locking plunger positioned coaxial with the piston head and having an annular end adapted to selectively engage the piston head groove in response to pressure exerted on the head, the annular end contacting the balls thus forcing them radially outward when the plunger end engages the piston groove;

spring means contacting the locking plunger for normally retaining it in a preselected engaged position relative to the piston groove;

radial plunger means radially displaced relative to the piston by the locking balls;

a recess formed in the radial plunger means; and a valve ball positioned in contact with the radial plunger means for moving into the recess upon movement of the radial plunger means to a preselected extreme radial position;

a port communicating with the piston head annular groove and the locking plunger annular end for causing disengagement between the locking plunger and piston head upon introduction of pressurized fluid into the port which moves the balls radially inward and away from the radial plunger means;

wherein a timer valve plunger, contacting the valve ball, is moved from one position to another when the valve ball moves into the recess.

2. The structure set forth in claim 1 wherein a fluid passage is formed in the radial plunger means for guiding pressurized fluid from the port to a surface of the radial plunger means thus causing the latter's extreme radial displacement.

3. The structure set forth in claim 2 together with a race transversely located relative to the radial plunger means for receiving locking balls when the piston and locking plunger are engaged.

4. A hydraulically driven valve actuator comprising:

a piston head having an annular groove transversely formed therein for receiving a plurality of locking balls;

a hollowed cylindrical plunger coaxially positioned over the piston and having an annular end adapted to engage the piston head groove in response to pressure against the piston head;

spring means for normally biasing the annular plunger end into engagement with the piston head groove, the annular plunger end contacting the balls and forcing them radially outward into a race upon engagement of the plunger end with the piston head groove;

generally radial plunger means extending outwardly, relative to the piston, by the locking balls received in the race;

a groove peripherally formed in the radial plunger means; and a valve ball positioned in contact with the radial plunger means and outside the peripheral groove thereby forcing a timer valve plunger into a first position;

a port communicating with the piston head annular groove and the locking plunger annular end for causing disengagement between the locking plunger and piston head upon introduction of pressurized fluid into the port which moves the balls radially inward and out from the race thus resulting in loss of contact between the balls and the radial plunger means;

fluid passages formed in the radial plunger means for guiding pressurized fluid from the port to a surface of the radial plunger means thus causing the latter's radial displacement inwardly, into the space previously occupied by the locking balls, the displacement of the radial plunger means causing alignment between the peripheral groove therein and the valve ball thus allowing the timer valve plunger to assume a second position.

5. The structure set forth in claim 4 wherein the inward end of the radial plunger means includes an arcuate section for contacting a plurality of locking balls when the balls rest in the race.

* * * * *